US006326118B1

(12) United States Patent
Silence et al.

(10) Patent No.: US 6,326,118 B1
(45) Date of Patent: Dec. 4, 2001

(54) SURFACE ALLOYED CORES FOR ELECTROSTATOGRAPHIC CARRIERS AND DEVELOPERS

(75) Inventors: Scott Silence, Fairport; Morris DeYoung, Farmington, both of NY (US); Merrilee Galloway, Norfolk, MA (US)

(73) Assignee: Xerox Corporation, Rochester, NY (US)

( * ) Notice: Subject to any disclaimer, the term of this patent is extended or adjusted under 35 U.S.C. 154(b) by 0 days.

(21) Appl. No.: 09/655,385

(22) Filed: Sep. 5, 2000

(51) Int. Cl.[7] ..... G03G 9/113

(52) U.S. Cl. ..... 430/111.1; 430/111.35; 430/111.3

(58) Field of Search ..... 430/111.1, 111.3, 430/111.31, 111.35, 137.13

(56) References Cited

U.S. PATENT DOCUMENTS

| | | | | |
|---|---|---|---|---|
| 3,590,000 | | 6/1971 | Palermiti et al. | 252/62 |
| 3,632,512 | * | 1/1972 | Miller | 430/111.3 |
| 3,718,594 | * | 2/1973 | Miller | 430/111.3 |
| 4,233,387 | | 11/1980 | Mammino et al. | 430/137 |
| 4,935,326 | | 6/1990 | Creatura et al. | 430/108 |
| 4,937,166 | | 6/1990 | Creatura et al. | 430/108 |
| 5,567,562 | | 10/1996 | Creatura et al. | 430/108 |
| 5,926,686 | | 7/1999 | Engström et al. | 419/37 |
| 6,039,784 | | 3/2000 | Luk | 75/231 |

* cited by examiner

*Primary Examiner*—Christopher Rodee
(74) *Attorney, Agent, or Firm*—Perman & Green, LLP

(57) ABSTRACT

A carrier and developer material for use in an electrostatographic imaging process comprises a metallic core material which has a diffusion-bonded surface alloy layer on the surface of the particle and an optional polymer layer overcoating the alloy layer. The carrier provides improved conductivity and triboelectric properties when used in an electrophotographic imaging process.

13 Claims, No Drawings

SURFACE ALLOYED CORES FOR ELECTROSTATOGRAPHIC CARRIERS AND DEVELOPERS

BACKGROUND OF THE INVENTION

1. Field of the Invention

This invention relates to specially alloyed metallic carriers for use in an electrostatographic developer material.

2. Description of Related Art

The electrostatographic process, and particularly the xerographic process, is well known. This process involves the formation of an electostatic latent image on a photoreceptor, followed by development of the image with a developer and subsequent transfer of the image to a suitable substrate. Numerous different types of xerographic imaging processes are known wherein, for example, insulative developer particles or conductive developer particles are selected depending on the development systems used.

The use of coated carrier particles in two-component developers is well known in the art.

Carrier particles for use in the development of electrostatic latent images are described in many patents including, for example, U.S. Pat. No. 3,590,000. These carrier particles may consist of various cores, including steel, with a coating thereover of fluoropolymers, and terpolymers of styrene, methacrylate, and silane compounds.

Typical carriers, coated carriers, their method of manufacture and developer compositions containing such carriers are disclosed in U.S. Pat. Nos. 4,233,387; 4,937,166; 4,935,326 and 5,567,562, the complete disclosure of which patents is incorporated herein by reference.

The main purpose of applying polymeric coatings on an iron or steel carrier core is to achieve high triboelectric and conductivity properties. However, aging or removal of these coatings by attrition results in poor triboelectric stability and triboelectric decay which is particularly a problem in color imaging using cyan, magenta and yellow toners.

Thus, it is desirable to provide developer carrier material which not only provides improved triboelectric and conductivity properties, but also maintains these properties over a longer period of time.

SUMMARY OF THE INVENTION

The present invention provides a developer material for use in an electrostatographic imaging process comprising a mixture of colored toner material and metallic carrier particles, the surface of said carrier particles comprising a layer of one or more alloy metals diffusion bonded thereto.

The invention also provides a coated carrier for use in an electrostatographic imaging process comprising metallic carrier particles, the surface of said carrier particles comprising a layer of one or more alloy metals diffusion bonded thereto, said particles being further overcoated with a coating comprising one or a mixture of polymers.

The carrier material with the surface alloy treatment provides many advantages over conventional metallic carriers. The surface alloy treatment is a chemical process which alters the surface chemistry of the metal as a result of diffusion of one or more metals without changing the magnetics of the bulk carrier core. Therefore, the magnetics of the bulk core are insensitive to the surface treatment and are essentially the same as that of the untreated iron core. Since the surface alloy treatment is a physical part of the carrier core rather than a simple coating, it will not be easily worn away or eroded during use thereby improving the triboelectric stability of the developer.

DETAILED DESCRIPTION OF THE INVENTION

The metallic particles used in the present invention may be characterized as particles of relatively pure iron (containing less than 0.2 wt % of carbon) or steel (containing about 0.2 to 1.5 wt % carbon) which have a layer of one or more other alloying metals diffused into the outer surfaces of the otherwise non-alloyed particle. The core of the particles is essentially iron or steel over which the alloy coating is formed by diffusion of one or more alloy metals into the outer surface of the particles. Generally, the alloy is formed only at the surface of the particle and at a thickness of less than about 2% of the particle diameter or less than about 1 micron. The shape of the metallic particles used in the present invention may vary from spherical to highly irregular, with the particles of highly irregular shape produced by standard water atomization or sponge steel production methods.

These particles may be manufactured by first forming the metallic particles by conventional processes and applying a coating or slurry of the desired alloy metal or mixed metals in the form of a reducable metal compound, or by forming a metal coating on the ferrite by ion vapor deposition, evaporation or electrodeposition methods. The coated cores may then be heated in an inert or reducing atmosphere at high temperature (up to 1000° C.) for a period of time sufficient such that the alloy metal diffuses into the surface of the metallic particle to form an iron/metal alloy.

Suitable metals which may be surface alloyed with iron include manganese, chromium, silicon, copper, nickel, molybdenum, aluminum, cobalt, silver, tin and zinc, as well as mixture of two or more such metals. The amount of metal surface alloyed is generally less than about 10% by weight, preferably less than about 6% by weight, based on the weight of the metal particle.

Suitable surface alloyed particles for use in the developer compositions of this invention are commercially available as metallurgical molding powders from the Hoganas AB (Sweden) under the trade names DISTALOY AB, AE, SA and SE, as well as ASTOLOY-Mo, ASTALOY-Cr, ASTALOY-CrM/77 and ASTALOY Mo/77. These materials are more generally described in U.S. Pat. Nos. 5,926,686 and 6,039,784, the disclosures of which patents are incorporated herein by reference.

The metallic carrier particles used in this invention may vary from spherical to highly irregular in shape and have a volume medium diameter in the range of from about 20 to 200 microns, more preferably from about 40 to 150 microns and most preferably about 50–125 microns, as measured by standard laser diffraction techniques, and a density as determined by ASTM Test B-212-89 in the range of about 2 to 4 $g/cm^3$, more preferably about 2.5 to 3.5 $g/cm^3$. The preferred embodiment for the shape of the metallic particles is irregular, with a surface morphology characteristic of that produced by water atomization of steel.

The carrier particles may be employed as a component in a developer composition with or without an additional polymer coating overlying the surface alloy layer. In a preferred embodiment, the carrier particles are further coated with one or a mixture of polymers to further modify the conductivity and triboelectric properties of the developer. Suitable polymers include those thermoplastics known in the prior art such as acrylic and methacrylic polymers, polyolefens, polystyrenes, polyvinylidene fluorides and like materials.

In a most preferred embodiment the metallic particles are coated with one or a mixture of at least two dry polymer components, which dry polymer components are preferably set not in close proximity thereto in the triboelectric series, and most preferably of opposite charging polarities with respect to the toner selected.

The electronegative polymer, i.e., the polymer that will generally impart a positive charge on the toner which it is contacted with, is preferably comprised of a polyvinylidenefluoride polymer or copolymer. Such polyvinylidenefluoride polymers are commercially available, for example under the tradename Kynar from Pennwalt. Kynar 301F is polyvinylidenefluoride and Kynar 7201 is copolyvinylidenefluoride/tetrafluorothylene.

The electropositive polymer, i.e., the polymer that will generally impart a negative charge on the toner which it is contacted with is preferably comprised of a polymer or copolymer of polymethyl methacrylate (PMMA), optionally having carbon black or another conductive material dispersed in the polymer. The PMMA may be copolymerized with any desired comonomer, so long as the resulting copolymer retains a suitable particle size. Suitable comonomers can include monoalkyl, or dialkyl amines, such as dimethylaminoethyl methacrylate, diethylamisoethyl methacrylate, diisopropylaminoethyl methacrylate, or t-butylaminoethyl methacrylate and the like. If the PMMA polymer has carbon black dispersed therein, it is preferably formed in a semisuspension polymerization process, for example as described in U.S. Pat. No. 5,236,629, incorporated by reference herein in its entirety.

If a mixture of at least two dry polymer components is selected, the percentage of each polymer present in the carrier coating mixture can vary depending on the specific components selected, the coating weight and the properties desired. Generally, the coated polymer mixtures used contain from about 3 to about 97 percent of the electronegative polymer, and from about 97 to about 3 percent by weight of the electropositive polymer.

The carrier particles may be prepared by mixing the carrier core with from, for example, between about 0.05 to about 10 percent by weight, more preferably between about 0.05 percent and about 3 percent by weight, based on the weight of the coated carrier particles, of the mixture of dry polymers until adherence thereof to the carrier core by mechanical impaction and/or electrostatic attraction. The mixture of carrier core particles and polymers is then heated to a temperature of, for example, between from about 200° F. to about 650° F., preferably 320° F. to 550° F., most preferably 330 to 420° F., for a period of time of from, for example, about 10 minutes to about 50 minutes, enabling the polymers to melt and fuse to the carrier core particles. The coated carrier particles are then cooled and thereafter classified to a desired particle size. The coating preferably has a coating weight of from, for example, 0.1–3.0% by weight of the carrier, preferably 0.1–1.0% by weight.

Various effective suitable means can be used to apply the polymer mixture coatings to the surface of the carrier core particles. Examples of typical means for this purpose include combining the carrier core material and the mixture of polymers by cascade roll mixing, or tumbling, milling, shaking, electrostatic powder cloud spraying, fluidized bed, electrostatic disc processing, and an electrostatic curtain. Following application of the polymer mixture, heating is initiated to permit flowout of the coating material over the surface of the carrier core. The concentration of the coating material powder particles, as well as the parameters of the heating step, may be selected to enable the formation of a continuous film of the coating material on the surface of the carrier core, or permit only selected areas of the carrier core to be coated.

Developers incorporating the coated carriers of the present invention can be formulated with constant conductivity values with different triboelectric charging characteristics by, for example, maintaining the same coating weight on the carrier particles and changing the polymer coating ratios. Similarly, there can be formulated developer compositions wherein constant triboelectric charging values are achieved and the conductivities are altered by retaining the polymer ratio coating constant and modifying the coating weight for the carrier particles.

In a most preferred embodiment of the present invention, the coated carriers are used in forming developers for use in production color machines. One type of color electrophotographic marking process, called image-on-image (IOI) processing, superimposes toner powder images of different color toners onto the photoreceptor prior to the transfer of the composite toner powder image onto the substrate. While the IOI process provides certain benefits, such as a compact architecture, there are several challenges to its successful implementation. For instance, the viability of printing system concepts such as IOI processing requires development systems that do not interact with a previously toned image. Since several known development systems, such as conventional magnetic brush development and jumping single-component development, interact with the image on the receiver, a previously toned image will be scavenged by subsequent development if interacting development systems are used. Thus, for the IOI process, there is a need for scavengeless or noninteractive development systems.

In the present invention, while any suitable electrostatic image development device may be used, it is most preferred to use a device employing the hybrid scavengeless development system. Such a system is described in, for example, U.S. Pat. No. 5,978,633, the entire disclosure of which is incorporated herein by reference. Hybrid scavengeless development (HSD) technology develops toner via a conventional magnetic brush onto the surface of a donor roll. A plurality of electrode wires is closely spaced from the toned donor roll in the development zone. An AC voltage is applied to the wires to generate a toner cloud in the development zone. This donor roll generally consists of a conductive core covered with a thin, for example 50–200 $\mu$m, partially conductive layer. The magnetic brush roll is held at an electrical potential difference relative to the donor core to produce the field necessary for toner development. The toner layer on the donor roll is then disturbed by electric fields from a wire or set of wires to produce and sustain an agitated cloud of toner particles.

Developers formed with carrier cores of the present invention satisfy the electrophotographic requirements of hybrid scavengeless development, in particular the need for high triboelectric values of from, for example, −25 to −70 $\mu$C/g, more preferably −40 to −60 $\mu$C/g, as measured by the well known Faraday cage technique, and the need for high developer and carrier conductivity, for example a carrier conductivity of between $10^{-8}$ and $10^{-12}$ (ohm-cm)$^{-1}$ as measured, for example, across a 0.1 inch magnetic brush at an applied potential of 10 volts.

Two component developer compositions of the present invention can be generated by admixing the carrier core particles with a toner composition comprised of resin particles and pigment particles. The toner concentration in the developer initially installed in a xerographic development housing is between 3.5 and 5 parts of toner per one hundred parts of carrier. Over the life of the developer, this concentration can vary from about 3.5 to about 7 parts of toner per one hundred parts of carrier with no significant impact on the copy quality of the resulting images.

Illustrative examples of finely divided toner resins selected for the developer compositions of the present invention include polyamides, epoxies, polyurethanes, diolefins, vinyl resins, styrene acrylates, styrene methacrylates, styrene butadienes, polyesters such as the polymeric esterification products of a dicarboxylic acid and a diol comprising a diphenol, crosslinked polyesters, and the like. Specific vinyl monomers include styrene, p-chlorostyrene vinyl naphthalene, unsaturated monoolefins such as ethylene, propylene, butylene and isobutylene, vinyl halides such as vinyl chloride, vinyl bromide, vinyl fluoride, vinyl acetate, vinyl propionate, vinyl benzoate, and vinyl butyrate; vinyl esters like the esters of monocarboxylic acids including methyl acrylate, ethyl acrylate, n-butyl-acrylate, isobutyl acrylate, dodecyl acrylate, n-octyl acrylate, 2-chloroethyl acrylate, phenyl acrylate, methylaphachloracrylate, methyl methacrylate, ethyl methacrylate, and butyl methacrylate, acrylonitrile, methacrylonitrile, acrylamide, vinyl ethers, inclusive of vinyl methyl ether, vinyl isobutyl ether, and vinyl ethylisopropenyl ketone, vinylidene halides such as vinylidene chloride and vinylidene chlorofluoride; N-vinyl indole, N-vinyl pyrolidone, and the like. Also, there may be selected styrene butadiene copolymers, mixtures thereof, and the like.

As one toner resin there can be selected the esterification products of a dicarboxylic acid and a diol comprising a diphenol, reference U.S. Pat. No. 3,590,000, the disclosure of which is totally incorporated herein by reference. Other preferred toner resins include styrene/methacrylate copolymers, styrene/butadiene copolymers; polyester resins obtained from the reaction of bisphenol A and propylene oxide; and branched polyester resins resulting from the reaction of dimethyl terephthalete, 1, 3-butanediol, 1, 2-propanediol and pentacrythritol, and reactive extruded polyesters. Generally, from about 1 part to about 5 parts by weight of toner particles are mixed with from about 10 to about 300 parts by weight of the carrier particles of the present invention.

Numerous well known suitable pigments or dyes can be selected as the colorant for the toner particles including, for example, carbon black like REGAL 330, nigrosine dye, lamp black, iron oxides, magnetites, colored magnetites other than black, and mixtures thereof. The pigment, which is preferably carbon black, should be present in a sufficient amount to render the toner composition highly colored. Thus, the pigment particles can be present in amounts of from about 3 percent by weight to about 20 and preferably from 5 to about 15 percent by weight, based on the total weight of the toner composition. However, lesser or greater amounts of pigment particles may be selected in embodiments.

When the pigment particles are comprised of magnetites, which are a mixture of iron oxides (FeO, $Fe_2$—$O_3$) including those commercially available as MAPICO BLACK, they are present in the toner composition in an amount of from about 10 percent by weight to about 70 percent by weight, and preferably in an amount of from about 20 percent by weight to about 50 percent by weight.

The resin particles are present in a sufficient, but effective amount. Thus when 10 percent by weight of pigment or colorant such as carbon black is contained therein, about 90 percent by weight of resin material is selected. Generally, however, the toner composition is comprised of from about 85 percent to about 97 percent by weight of toner resin particles, and from about 3 percent by weight to about 15 percent by weight of pigment particles such as carbon black.

Also encompassed within the scope of the present invention are colored toner and developer compositions comprised of toner resin particles, carrier particles, and as pigments or colorants, red, green, brown, blue, magenta, cyan and/or yellow particles, as well as mixtures thereof. More specifically, illustrative examples of magenta materials that may be selected as pigments include 1, 9-dimethyl-substituted quinacridone and anthraquinone dyes identified in the color index as CI60720, CI Dispersed Red 15, a diazo dye identified in the color index as CI26050, CI Solvent Red 19, and the like. Examples of cyan materials that may be used as pigments include copper tetra-4 (octaecyl sulfonamido) phthalocyanine, X-copper phythalocyanine pigment listed in the color index at CI 74160, CI Pigment Blue, and Anthrathreme Blue, identified in the color index as CI 69810, Special Blue X-2137, and the like, while illustrative examples of yellow pigments that may be selected are diarylide yellow 3, 3-dichlorobenzidene acetoacetanilides, monoazo pigment identified in the color index as CI 12700, CI Solvent Yellow 16, a nitrophenyl amine sulfonamide identified in the color index as Foron Yellow SE/GLN, CI Dispersed Yellow 33, 2.5-dimethoxy-4-sulfonanilide phenylazo-4-chloro-2,5-dimethoxy acetoacetanilide, permanent yellow FGL, and the like. These pigments are generally present in the toner composition in an amount of from about 1 weight percent to about 15 weight percent based on the weight of the toner resin particles.

For further enhancing the positive charging characteristics of the developer compositions described herein, and as optional components there can be incorporated into the toner or on its surface charge enhancing additives inclusive of alkyl pyridinium halides, reference U.S. Pat. No. 4,298,672, the disclosure of which is totally incorporated herein by reference; organic sulfate or sulfonate compositions, reference U.S. Pat. No. 4,338,390, the disclosure of which is totally incorporated herein by reference; distearyl dimethyl ammonium sulfate; bisulfates, and the like and other similar known charge enhancing additives. Also, negative charge enhancing additives may also be selected, such as aluminum complexes, like BONTRON E-88, and the like. These additives are usually incorporated into the toner in an amount of from about 0.1 percent by weight to about 20 percent by weight, and preferably from 1 to about 3 percent by weight.

The toner composition of the present invention can be prepared by a number of known methods including melt blending the toner resin particles, and pigment particles or colorants followed by mechanical attrition. Other methods include those well known in the art such as spray drying, melt dispersion, dispersion polymerization, suspension polymerization, and extrusion. In one dispersion polymerization method, a solvent dispersion of the resin particles and the pigment particles is spray dried under controlled conditions to result in the desired product. Generally, the toners are prepared by mixing, followed by attrition, and classification to enable toner particles with an average volume diameter of from about 5 to about 20 microns.

Also, the toner and developer compositions of the present invention may be selected for use in electrostatographic imaging processes containing therein conventional photoreceptors, including inorganic and organic photoreceptor imaging members. Examples of imaging members are selenium, selenium alloys, and selenium or selenium alloys containing therein additives or dopants such as halogens. Furthermore, there may be selected organic photoreceptors illustrative examples of which include layered photoresponsive devices comprised of transport layers and photogenerating layers, reference U.S. Pat. No. 4,265,990, the disclosure of which is totally incorporated herein by reference, and other similar layered photoresponsive devices. Examples of generating layers are trigonal selenium, metal phthalocyanines, metal free phthalocyanines and vanadyl phthalocyanines. As charge transport molecules there can be selected the aryl diamines disclosed in U.S. Pat. No. 4,265,990. Also, there can be selected as photogenerating pigments squaraine compounds, thiapyrillium materials, and the like. These layered members are conventionally charged negatively thus requiring a positively charged toner. Moreover, the developer compositions of the present invention are particularly useful in electrostatographic imaging processes and apparatuses wherein there are selected a moving transporting means and a moving charging means, and wherein there is selected a deflected flexible layered imaging member, reference U.S. Pat. Nos. 4,394,429 and 4,368,970, the disclosures of which are totally incorporated herein by reference.

The following examples are illustrative of the invention.

EXAMPLE 1

The electrostatographic properties of four commercially available surface alloyed iron particles from Hoganas AB (Sweden) were evaluated vs. a standard steel carrier as a control.

Materials evaluated were:

A—Astaloy CrMo/90—iron containing 2.65 wt % surface alloyed chromium and 0.54 wt % surface alloyed molybdenum B—Astaloy Mo/90—iron containing 1.49 wt % surface alloyed molybdenum C—Astaloy CrMo/77 —iron containing 2.74 wt % surface alloyed chromium and 0.49 wt % surface alloyed molybdenum D—Astaloy Mo/77—iron containing 1.50 wt % surface alloyed molybdenum Control—non-surface alloyed steel carrier composed of greater than 99 wt % iron with less than 0.20% oxygen and less than 0.02% carbon content.

The physical properties of these carrier cores are shown in Table 1. The V(0.5) value in Table 1 reflects the volume median particle size, and all. of the particle size metrics are measured by standard laser diffraction techniques. The mass flow and bulk density measurements are determined by the standard Hall flow meter test and surface area (SA) is determined by standard BET surface area measurements. The conductivity of these carrier cores are also shown in Table 1 as determined by measuring the current flow across a 0.1 inch magnetic brush at an applied potential of 10 volts. Each of these carrier cores was then combined with 3.5 wt % of a 7.4 micron median diameter cyan toner made from a polyester resin which contains silica, titania, and zinc stearate surface additives. The triboelectric properties of each developer were then evaluated and are shown in Table 1. The triboelectric values were measured by the standard Faraday cage blow-off technique.

TABLE 1

| Parameter | A | B | C | D | CONTROL |
|---|---|---|---|---|---|
| Particle Size Distribution By Volume (Microns) | | | | | |
| V (0.5) | 94.6 | 95.2 | 79.8 | 78.8 | 80.4 |
| V (0.1) | 48.0 | 39.9 | 55.9 | 55.9 | 58.3 |
| V (0.9) | 162.8 | 200.2 | 115.1 | 112.6 | 114.5 |
| Pass 38$\mu$m (%) | 4.73 | 8.77 | 1.45 | 1.40 | 1.00 |
| App Density (g/cm$^3$) | 2.76 | 3.31 | 2.69 | 3.12 | 3.01 |
| Mass Flow (g/sec) | 1.87 | 2.47 | 1.95 | 2.35 | 1.78 |
| BET-SA (cm$^2$/g) | 386 | 347 | 475 | 366 | 474–605 |
| Electrophotographic Properties | | | | | |
| Cond. (ohm–cm)$^{-1}$ | 2.16E–05 | 1.46E–06 | 1.37E–05 | 1.50E–06 | 2.57E–08 |
| Satuation | | | | | |
| Mag. (emu/g) | 190 | 195 | 189 | 191 | 180–190 |
| TRIBO ($\mu$C/g) | 30.32 | 30.27 | 25.22 | 33.29 | 18.12 |

The data show that the conductivity of developers A–D is greater than or equal to the standard control steel carrier, the saturation magnetization remains constant (and equivalent to or greater than the control steel carrier) and the triboelectric value increases relative to the control to a value as high as 33 microcoulombs per gram for developer D, nearly twice the tribo value for the control.

EXAMPLE 2

Carrier core C and the control core were coated with 1 wt % of polymethylmethacrylate as follows.

In the first step of the carrier coating process, the carrier core particles are mixed in a Munson blender with PMMA polymer. The PMMA is MP16 Fines obtained from Soken Chemical Company. Sufficient polymer mixture is provided to derive a final coating weight of 1%. In the second step of the coating process, the polymer is fused in a rotary kiln maintained at a temperature of 385° F. and the residence time of the carrier in the furnace is maintained at 30 minutes.

The conductivity of these polymer-coated carriers are shown in Table 2 as determined in Example 1. Each of these polymer-coated carriers was then combined with 3.5 wt % of Toner 1, a 7.4 micron median diameter cyan toner made from a polyester resin which contains no surface additives and separately combined with 3.5 wt % of Toner 2, a 7.4 micron median diameter cyan toner made from a polyester resin which contains silica, titania, and zinc stearate surface additives. Toner 2 is identical to the toner described in Example 1. The triboelectric properties of each developer were then evaluated and are shown in Table 2. The triboelectric values were measured by the standard Faraday cage blow-off technique.

TABLE 2

| Parameter | C | CONTROL |
|---|---|---|
| Conductivity (ohm–cm)[1] | 7.2E–07 | 1.7E–10 |
| TRIBO ($\mu$C/g) - Toner 1 | 40.3 | 28.9 |
| TRIBO ($\mu$C/g) - Toner 2 | 57.5 | 43.4 |

The data show that the conductivity of developer C is greater than the standard control steel carrier and the triboelectric value increases relative to the control to a value as high as 57.5 microcoulombs per gram for developer C. For Toner 1 and Toner 2 an increase of approximately 12 and approximately 14 microcoulombs per gram are observed for developer C, relative to the control, respectively.

What is claimed is:

1. A developer material for use in an electrostatographic imaging process comprising a mixture of colored toner material and metallic carrier particles, the surface of the carrier particles comprising an alloy layer of one or more alloy metals diffusion bonded thereto.

2. The developer of claim 1 wherein said alloy metals are selected from the group consisting of manganese, chromium, silicon, copper, nickel, molybdenum, aluminum, cobalt, silver, tin, zinc and mixtures thereof.

3. The developer of claim 1 wherein said carrier particles are iron or steel, and wherein said alloy layer has a thickness of less than about 1 micron.

4. The developer material of claim 1 wherein said particles are further overcoated with a coating comprising one polymer or a mixture of polymers.

5. The developer material of claim 4 wherein said polymer comprises a methyl methacrylate homopolymer or copolymer.

6. The developer of claim 4 wherein said polymer comprises a vinylidene fluoride homopolymer or copolymer.

7. The developer of claim 1 wherein said alloy metal comprises molybdenum.

8. The developer of claim 1 wherein said alloy metal comprises chromium.

9. A coated carrier for use in a developer for an electrostatographic imaging process comprising metallic carrier particles, the surface of the carrier particles comprising an alloy layer of one or more alloy metals diffusion bonded thereto, the particles being further overcoated with a coating comprising one polymer or a mixture of polymers whereby the triboelectric stability and conductivity properties of the developer are modified, the polymer or polymers being selected from the group consisting of a methylmethacrylate homopolymer, a methylmethacrylate copolymer, a vinylidene fluoride homopolymer, and a vinylidene fluoride copolymer.

10. The carrier of claim 9 wherein said alloy metals are selected from the group consisting of manganese, chromium, silicon, copper, nickel, molybdenum, aluminum, cobalt, silver, tin, zinc and mixtures thereof.

11. The carrier of claim 9 wherein said carrier particles are iron or steel, and wherein said alloy layer has a thickness of less than about 1 micron.

12. The carrier of claim 9 wherein said alloy metal comprises molybdenum.

13. The carrier of claim 9 wherein said alloy metal comprises chromium.

* * * * *

UNITED STATES PATENT AND TRADEMARK OFFICE
Certificate

Patent No. 6,326,118 B1

Patented: December 4, 2001

On petition requesting issuance of a certificate for correction of inventorship pursuant to 35 U.S.C. 256, it has been found that the above identified patent, through error and without deceptive intent, improperly sets forth the inventorship.

Accordingly, it is hereby certified that the correct inventorship of this patent is: Scott Silence, Fairport, NY; Morris DeYoung, Farmington, NY; Merrilee Galloway, Norfolk, MA; Richard P. N. Veregin, Ontario, Canada; Stephan V. Drappel, Toronto, Canada; and Gerald R. Allison, Sherbrooke, Nova Scotia, Canada.

Signed and Sealed this Twenty-fifth Day of June 2002.

MARK F. HUFF
*Supervisory Patent Examiner*
Art Unit 1756